US006474001B1

(12) United States Patent
Chen

(10) Patent No.: US 6,474,001 B1
(45) Date of Patent: Nov. 5, 2002

(54) WATERPROOF SHOE HAVING STITCH SEAM FOR DRAINAGE II

(76) Inventor: Eddie Chen, 4F, No. 255, Sec. 1, Taichung-Kang Rd., Taichung City (TW)

( * ) Notice: Subject to any disclaimer, the term of this patent is extended or adjusted under 35 U.S.C. 154(b) by 0 days.

(21) Appl. No.: 09/591,201

(22) Filed: Jun. 9, 2000

Related U.S. Application Data

(63) Continuation-in-part of application No. 09/209,597, filed on Dec. 11, 1998, now Pat. No. 6,065,227.

(51) Int. Cl.[7] ..... A43B 23/07
(52) U.S. Cl. ..... 36/55; 36/14
(58) Field of Search ..... 36/55, 14, 4

(56) References Cited

U.S. PATENT DOCUMENTS

| | | | | |
|---|---|---|---|---|
| 32,575 A | | 6/1861 | Meyer | |
| 967,064 A | | 8/1910 | Savage | |
| 1,725,749 A | | 8/1929 | Blair | |
| 2,200,333 A | | 5/1940 | Herzog et al. | 36/4 |
| 2,306,306 A | | 12/1942 | Ferrettie | 36/4 |
| 2,428,626 A | | 10/1947 | Jaeger et al. | 36/4 |
| 3,668,056 A | | 6/1972 | Hayes, Jr. | 161/159 |
| 4,599,810 A | | 7/1986 | Sacre | 36/55 |
| 4,707,874 A | | 11/1987 | Champagne | 12/142 E |
| 5,526,584 A | | 6/1996 | Bleimhofer et al. | 36/10 |
| 5,678,326 A | | 10/1997 | Pavelescu | 36/14 |
| 5,778,473 A | | 7/1998 | Chen | 12/142 T |
| 6,065,227 A | * | 5/2000 | Chen | 12/142 A |
| 6,088,935 A | * | 7/2000 | Pavelescu et al. | 36/14 |
| 6,115,940 A | * | 9/2000 | Chen | 12/142 E |

FOREIGN PATENT DOCUMENTS

| | | |
|---|---|---|
| DE | 607267 | 12/1934 |
| FR | 2526668 | 11/1983 |
| NO | 52613 | 5/1933 |

* cited by examiner

*Primary Examiner*—Ted Kavanaugh
(74) *Attorney, Agent, or Firm*—Fish & Richardson P.C.

(57) ABSTRACT

A waterproof shoe includes an upper having a bottom open end secured to an insole, and a waterproof but vapor pervious lining sleeve disposed inside the upper. The lining sleeve includes a top open end connected to the top open end of the upper, and a bottom open end extending along an inner surface of the upper and ending at a distance from and above the bottom end of the upper. The bottom open end of the lining sleeve is stitched to the upper to form a seam. Waterproof means is attached to the inner surface of the upper and the inner surface of the lining sleeve adjacent to and along the seam so that the water invading the shoe can be diverted to drain out of the shoe through the seam.

5 Claims, 6 Drawing Sheets

WATERPROOF SHOE HAVING STITCH SEAM FOR DRAINAGE II

This application is a continuation-in-part application of U.S. application Ser. No. 09/209,597 filed Dec. 11, 1998, now U.S. Patent No. 6,065,227.

BACKGROUND OF THE INVENTION

1. Field of the Invention

The invention relates to a waterproof shoe, more particularly to a waterproof shoe with an inner liner which is made of a water impervious but vapor-permeable material disposed inside an upper and which has a bottom open end stitched to the upper to form a draining seam above the bottom end of the upper.

2. Description of the Related Art

Conventional waterproof shoes generally include an outer shell made of a waterproofing material which is impervious to air and vapor. Such waterproof shoes tend to cause discomfort to the wearer as ventilation of perspiration vapors gathered around the wearer's feet is not permitted. Improvements available in the art for coping with such perspiration problems include the use of a non-waterproof material, such as leather or fabric, for the outer shell of an upper and the use of a sock-like liner, which is made of a material or laminate impervious to water but pervious to perspiration vapor, as a protection part for the foot against water intrusion. In particular, shoe constructions with such an improvement generally include a sock-like liner which has a top open end secured to the top open end of an upper, and a bottom wall seating on and bonded adhesively to a midsole which is secured to the bottom end of the upper. A disadvantage found in such constructions is that water can seep into the interior of the shoe through the seams of the shoe and can be trapped in the space between the upper and the sock-like liner.

Attempts have been made in order to alleviate the aforesaid water seeping problems by improving the waterproofing characteristics of the waterproof breathable shoes. U.S. Pat. No. 5,678,326 suggests an improved shoe construction which comprises an outer shell connected to an insole, a waterproof, water-vapor permeable shoe insert disposed inside the outer shell, and a lining provided inside the shoe insert. Both of the lining and the shoe insert have their bottom walls extending between an outsole and an insole, and are secured to the bottom portion of the upper and to the outsole and insole by using several layers of adhesive.

As described hereinabove, the prior art addressed the aforesaid water seeping problem by focusing on improvements on the waterproofing characteristics of the shoes. The technical measures taken in the art to enhance the waterproofing characteristics, however, tend to reduce the ventilating characteristics and vapor permeability of shoes.

The basic U.S. application of this application which is Ser. No. 09/209,597 discloses a waterproof boot construction designed to provide a drain outlet for the water invading the boot. The boot construction as disclosed therein comprises an outer shell having an upper of non-waterproof material, and a lower of waterproof material and utilizes a waterproof, water-vapor permeable inner lining sleeve to line the upper. The bottom ends of the upper and the lining sleeve are stitched to a top end of the lower, and a water-tight seal is provided inside the lining sleeve and the lower so that the water seeping through the stitched seam into the space between the lining sleeve and the upper is prevented from invading the interior of the lining sleeve and the lower and is diverted to the stitched seam for drainage. The drain outlet formed as such is located along the stitched joint of the overlapping parts of the upper and the lower of the boot.

U.S. Pat. No. 4,599,810 discloses stitchdown shoes which incorporate waterproof, vapor permeable sock-like liners and which provide good ventilating property. In the construction of these shoes, although a stitchdown formed at the joint of a midsole and an upper permits ventilation, since a padding, which is typically made of a fibrous or foamed material, is disposed between the inner surface of the upper and the sock-like liner, the water penetrating through the stitchdown can be retained in the padding due to the water-wicking property of the padding. The wet padding not only adds weight to the shoe but also reduces the warmness of the shoe. On the other hand, the sock-like liner used in this shoe construction has a bottom wall which seats on a midsole and is secured adhesively thereto. The need to provide the liner with the bottom wall complicates the process of making the shoe and increases the consumption of expensive waterproof, vapor permeable material. The procedure for securing adhesively the bottom wall of the liner to the midsole is also cumbersome and time-consuming.

SUMMARY OF THE INVENTION

An object of the present invention is to provide a waterproof shoe which permits the wearer's feet to breathe and which has a drain outlet for the water invading the interior of the shoe.

Another object of the present invention is to provide a waterproof breathable shoe which can be produced via a less complicated process with reduced consumption of expensive waterproof breathable material.

According to the present invention, a waterproof shoe comprises: an upper including a top open end and a bottom open end; and a lining sleeve disposed inside the upper, the lining sleeve having a top open end connected to the top open end of the upper, and a bottom open end extending along an inner surface of the upper and ending at a distance from and above the bottom open end of the upper. The bottom open end of the lining sleeve is stitched to the upper to form a seam, and the lining sleeve is made of a material which is impervious to water but is pervious to perspiration vapors. Waterproof means is attached to the inner surface of the upper and the inner surface of the lining sleeve adjacent to and along the seam so that the water invading the shoe can be diverted to drain out of the shoe through the seam.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
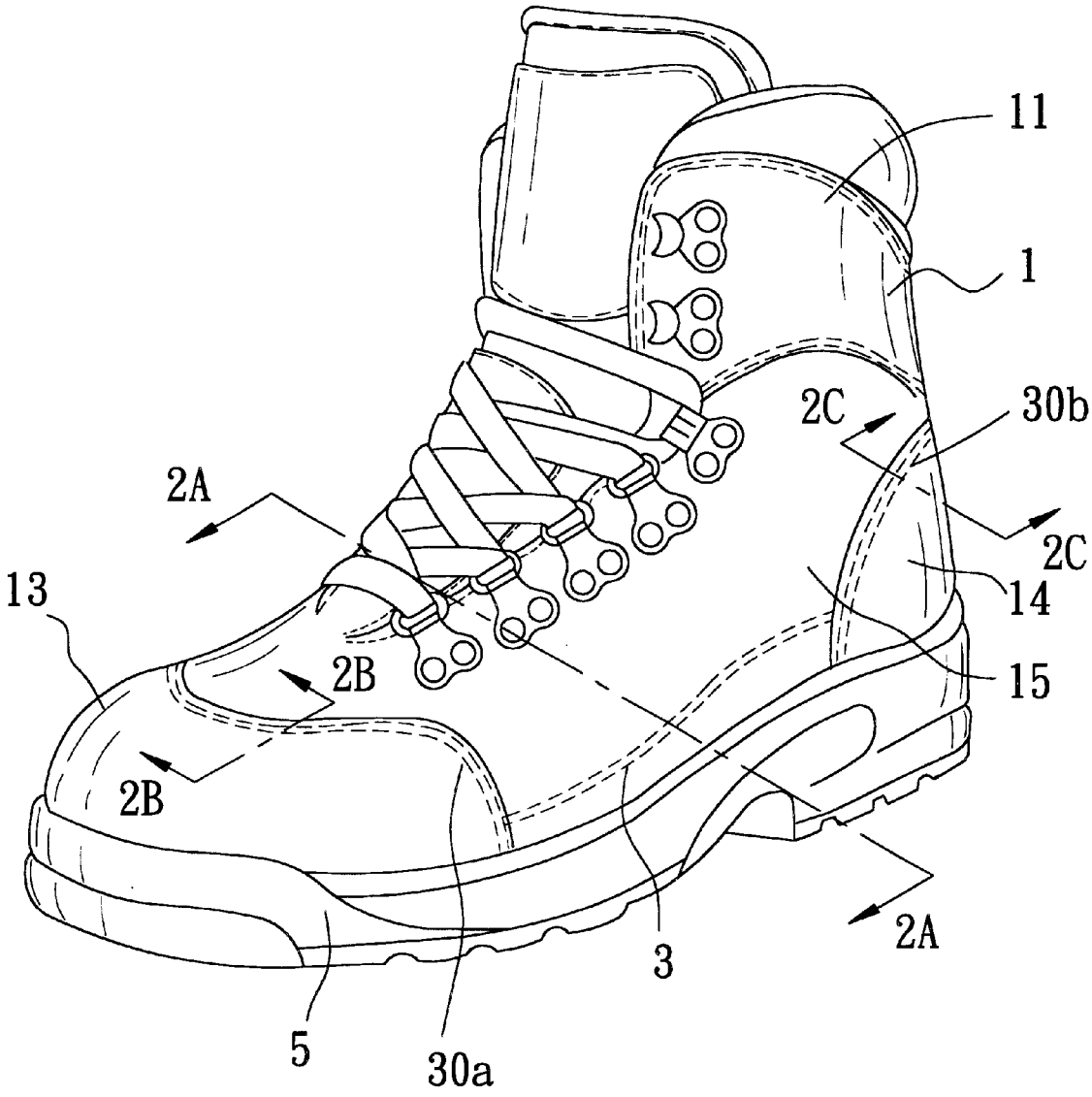
FIG. 1 is a perspective view of a preferred embodiment of the waterproof shoe according to the present invention.
Figure 2A:
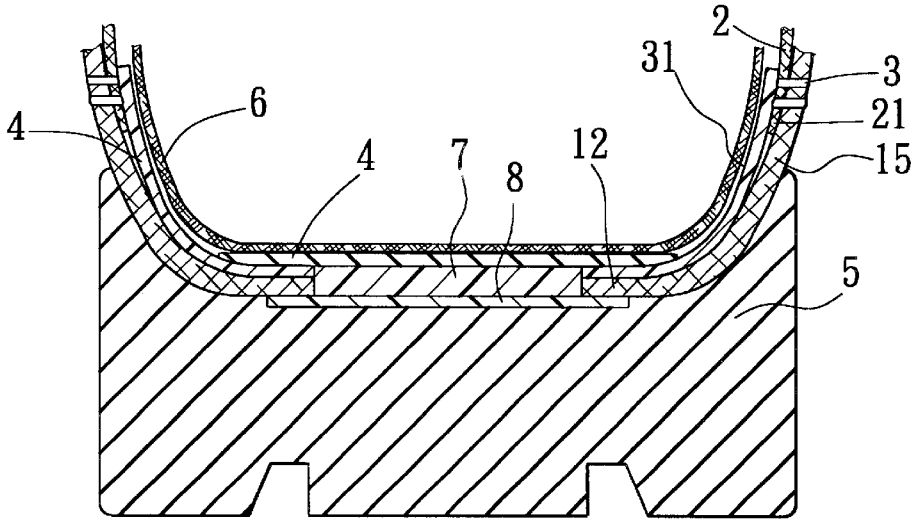
FIG. 2A is a fragmentary sectional view taken along line 2A—2A of FIG. 1.
Figure 2B:
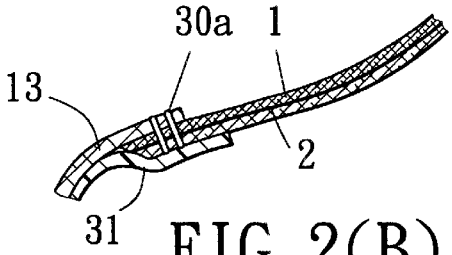
FIG. 2B is a fragmentary sectional view taken along line 2B—2B of FIG. 1.
Figure 2C:
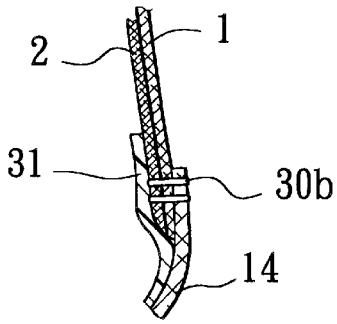
FIG. 2C is a fragmentary sectional view taken along line 2C—2C of FIG. 1.

Referring to FIGS. 1, 2A, 2B and 2C, a preferred embodiment of the waterproof shoe according to the present invention is shown to include an upper 1 having a toe cap 13 and a counter 14. The toe cap 13 and the counter 14 are stitched to a quarter section 15 of the upper 1 so that a seam 30*a* is formed between the toe cap 13 and the quarter section 15 and a seam 30*b* is formed between the counter 14 and the quarter section 15. The toe cap 13 and counter 14 are preferably made of a waterproof material, such as rubber, PVC, PU or a waterproof leather. The upper 1 has a bottom open end lasted to form an inwardly turned bottom flange 12. A lining sleeve 2 is disposed inside the upper 1 and has a top open end (not shown) secured to the top open end 11 of the upper 1 in a conventional manner. The lining sleeve 2 is made of a typical material which is impervious to water but pervious to perspiration vapors, and may consist of a shaped single piece, or a plurality of pieces which are connected together via a stitching process followed by a watertight sealing process in a conventional manner. The lining sleeve 2 has a configuration substantially conforming to the interior of the upper 1 but has a bottom open end 21 which ends at a distance from and above the bottom flange 12 of the upper 1 and which extends along and is connected to the seams 30*a* and 30*b*. As shown in FIG. 2B, a portion of the bottom open end 21 of the lining sleeve 2 extends to the marginal end of the quarter section 15 which overlaps the toe cap 13, and is connected to the quarter section 15 and the toe cap 13 along the seam 30*a*. As shown in FIG. 2C, another portion of the bottom open end 21 of the lining sleeve 2 extends to the other marginal end of the quarter section 15 which overlaps the counter 14, and is connected to the quarter section 15 and the counter 14 along the seam 30*b*. As shown in FIG. 2A, the remaining portions of the bottom open end 21 of the lining sleeve 2 are stitched to the quarter section 15 along seams 3 at the medial and lateral sides of the upper 1. The quarter section 15 has no jointed overlapping parts at the seams 3. Note that the bottom open end 21 of the lining sleeve 2 does not extend below the intersection of the seams 3 and 30*a* and the intersection of the seams 3 and 30*b*.

A waterproof tape 31 is adhesively bonded to the inner surface of the upper 1 and the inner surface of the lining sleeve 2 adjacent to and along the inner side of the stitched seams 3, 30*a* and 30*b*. The bottom end of the waterproof tape 31 extends to the bottom flange 12 of the upper 1. The waterproof tape 31 serves to prevent the water invading through the stitched seams 3, 30*a* and 30*b* from entering the interior of the lower part of the upper 1 and divert drainage of the invading water to the outside of the shoe through the stitched seams 3, 30*a* and 30*b*. The waterproof tape 31 also provides enhanced waterproofness at the bottom end of the upper 1.

The bottom flange 12 of the upper 1 and the bottom end of the waterproof tape 31 are secured to an insole and an outsole 5 by means of a watertight soling process, such as injecting or applying an adhesive, etc. A filler 7 is inserted into an opening confined by the bottom flange 12 of the upper 1 and by the bottom end of the waterproof tape 31 between the insole and outsole 4 and 5. A waterproof cover 8 is provided beneath the filler 7. A conventional inner liner 6 which has a shape substantially conforming to that of the inner surface of the upper 1 is disposed inside the lining. sleeve 2 in a conventional manner in order to provide comfort and durability. If desired, a foot-like padding (not shown) may be disposed on a bottom wall of the inner liner 6 in a conventional manner.

Figure 3:
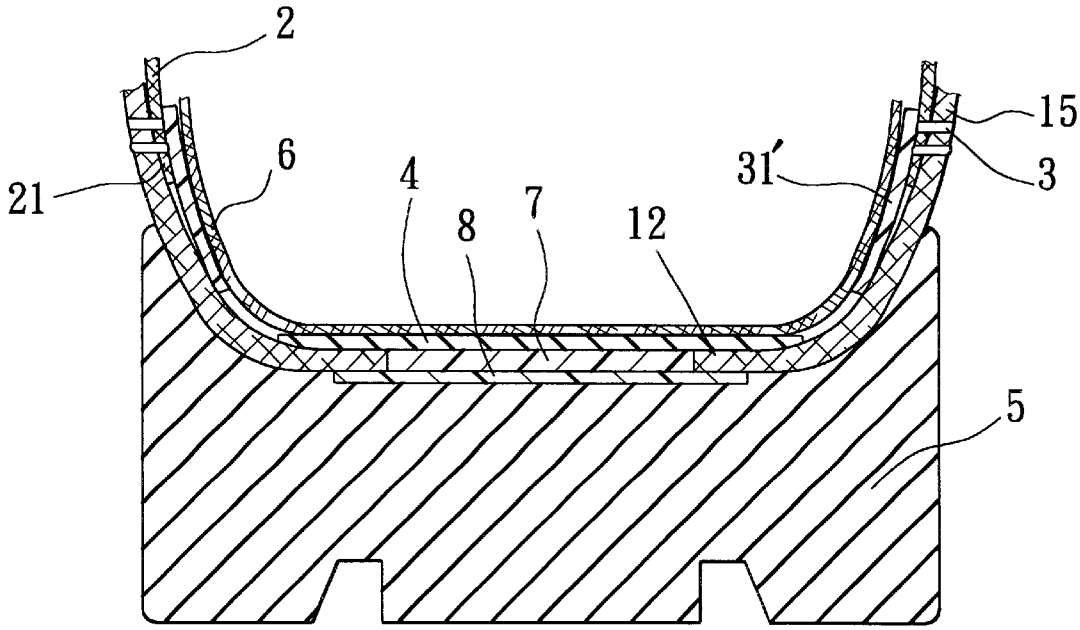
FIG. 3 is the same view as FIG. 2A but with the waterproof tape not extending to the bottom flange of the upper.

Although the waterproof tape 31 shown in FIG. 2 extends to the bottom flange 12 of the upper 1, the present invention is not limited thereto. As shown in FIG. 3, a waterproof tape 31' is formed as a strip that does not extend to the bottom flange 12 of the upper but extends along the stitched seams 3, 30*a* and 30*b*. In this case, the quarter section 15 should be made of a waterproof material so as to ensure that the lower part of the quarter section 15 below the strip is waterproof. In place of the waterproof tape 31, 31' a waterproof coating may be applied to the inner surfaces of the upper 1 and the lining sleeve 2 in a conventional manner.

Figure 4:
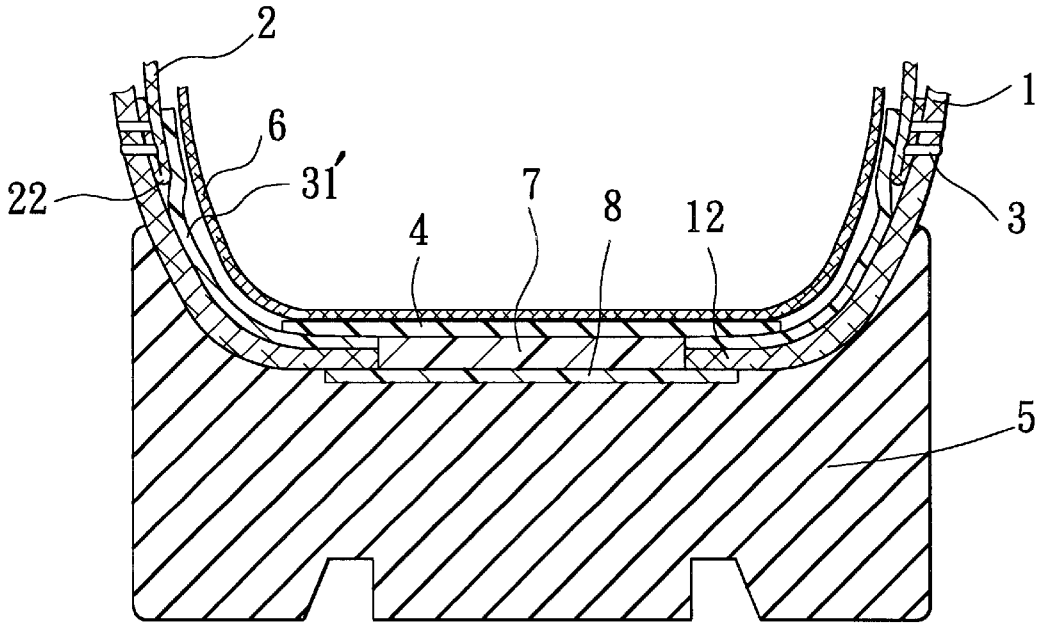
FIG. 4 is the same view as FIG. 2A but with the bottom end of the lining sleeve being folded upward.
Figure 5:
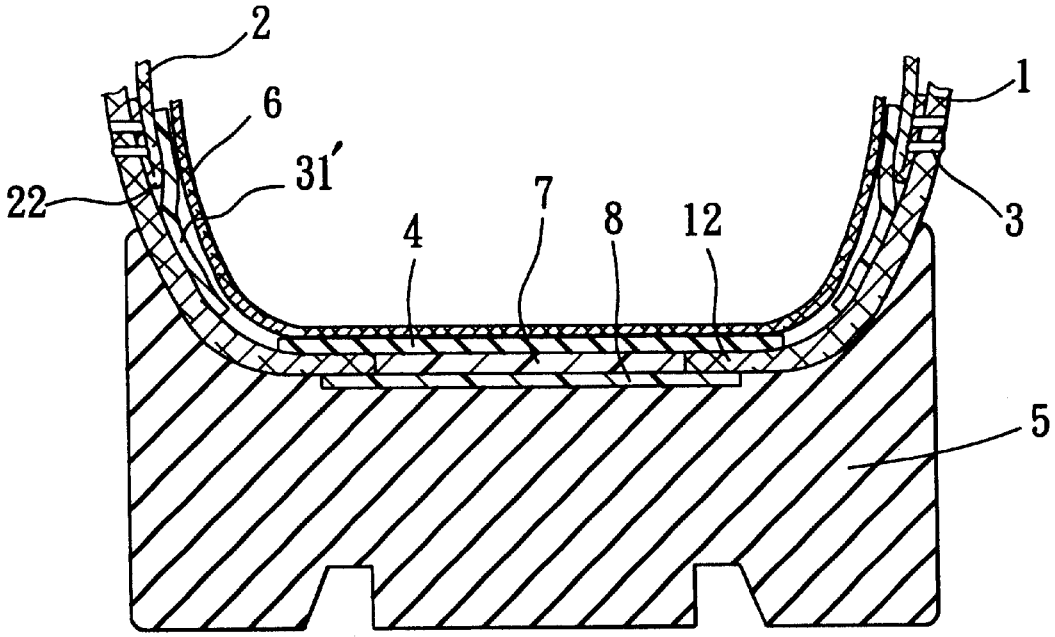
FIG. 5 is the same view of FIG. 2A but with the bottom end of the lining sleeve being folded upward and with the waterproof tape not extending to the bottom flange of the upper.

FIGS. 4 and 5 show other embodiments of the present invention which are substantially similar to those shown in FIGS. 2 and 3 except that the lining sleeve 2 has a folded bottom end 22 which. is turned upward and outward and which is stitched to the upper 1. The folded bottom end 22 can provide an enhanced waterproofing effect as it effectively prevents downward flowing of the invading water.

Figure 6:
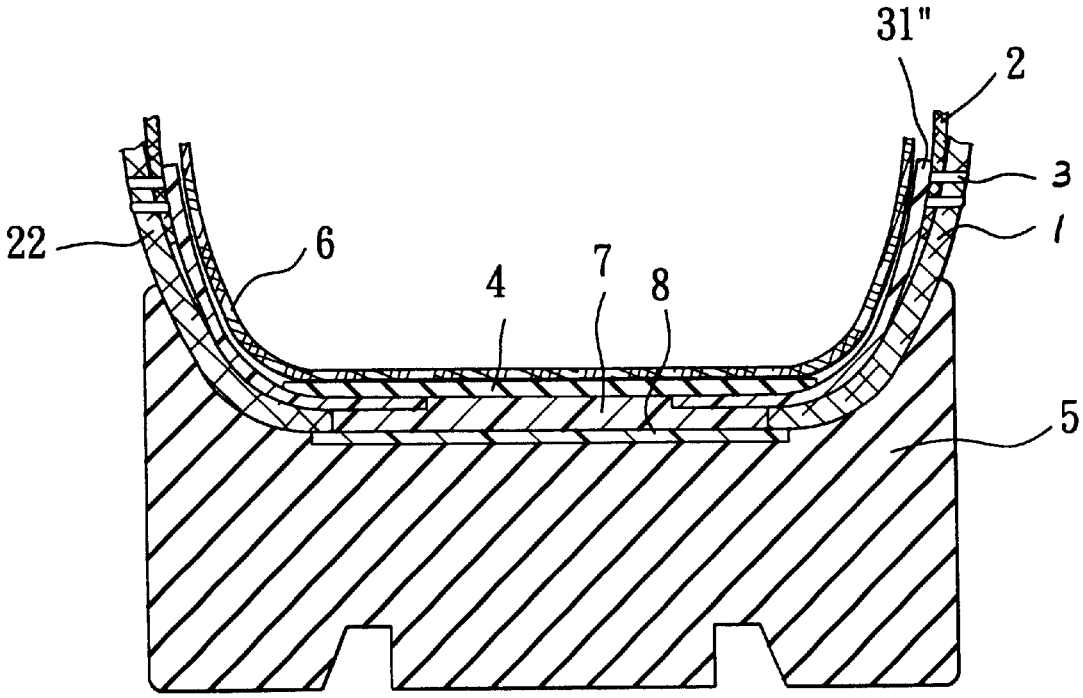
FIG. 6 is the same view as FIG. 2A but with a more longer waterproof tape extending to the bottom flange of the upper.

FIG. 6 shows another embodiment of the present invention which is substantially similar to that shown in FIGS. 1–2C except that the bottom end of the waterproof tape 31" has a dimension greater than that of the bottom flange 12 of the upper 1. The construction as such permits saving of the material of the upper and facilitates the manufacturing process.

Figure 7:
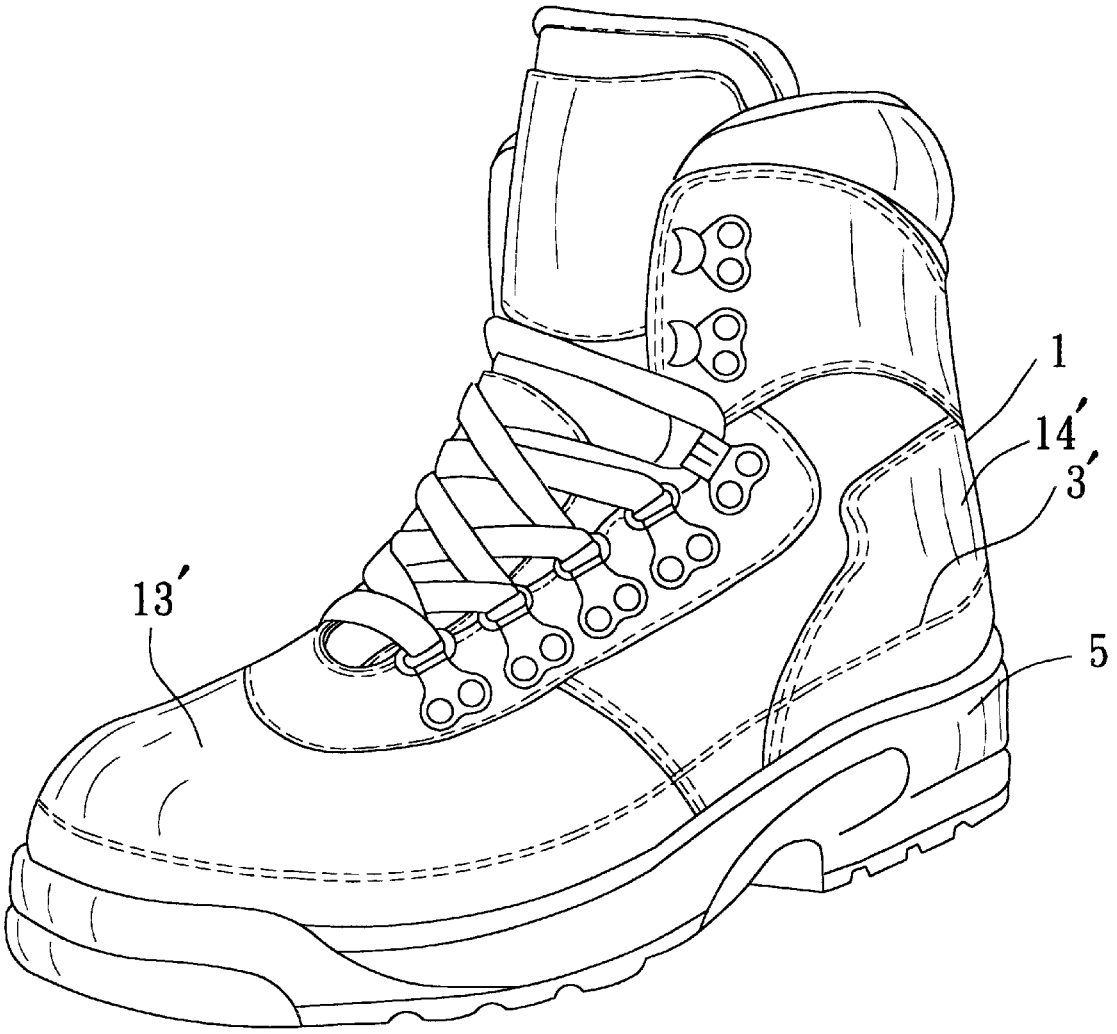
FIG. 7 is a perspective view of another embodiment of the waterproof shoe according to the present invention.

FIG. 7 shows still another embodiment of the present invention which is substantially similar to that shown in FIG. 1 except that the bottom end 21 or 22 of the lining sleeve 2 is stitched to the upper 1 along a seam 3' which forms a loop that extends from a toe part 13' to a heel part 14' and returns to the toe part 13' from the heel part 14'.

In fabrication, the lining sleeve 2 is first stitched to the upper 1, and the stitched seams 3, 30*a* and 30*b* or the seam 3' formed as such are subjected to a waterproofing treatment by using the adhesive tape 31 or 31'. Then, the insole 4 is connected to the upper 1. Finally, the outsole 5 is attached to the upper 1 and the insole 4. The inner liner 6 is placed inside the lining sleeve 2 in a conventional manner.

Figure 8:
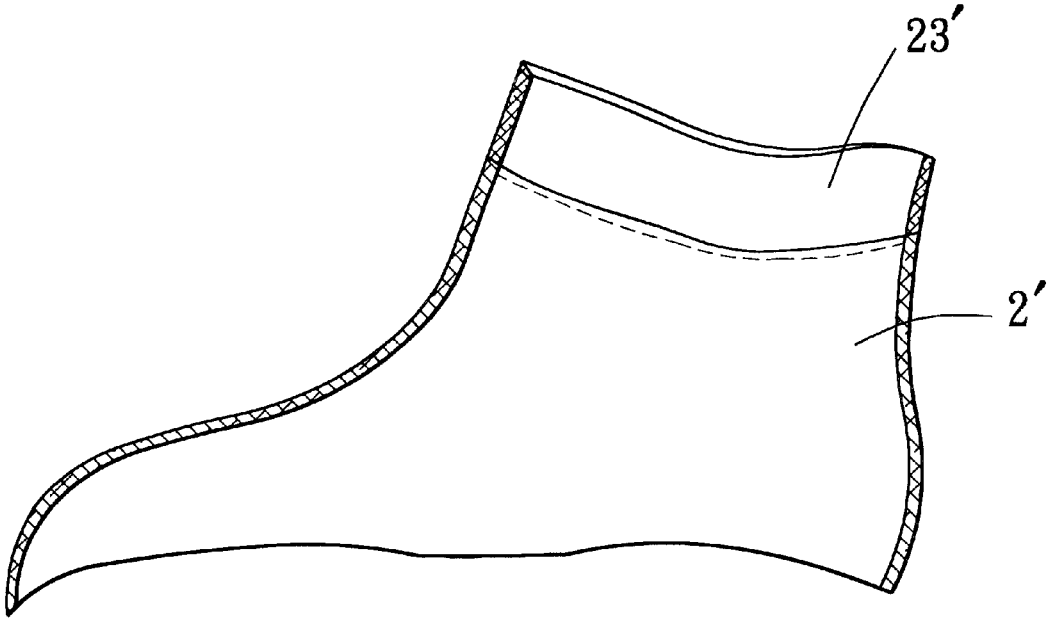
FIG. 8 shows a different example of the lining sleeve used in the present invention.

For economical purposes, the cost of the expensive material of the lining sleeve 2 may be reduced by shortening the dimension of the upper part of the lining sleeve 2. An example of the shortened lining sleeve is shown at 2' in FIG. 8 and includes a fabric part 23' stitched to the top open end of the lining sleeve 2' for connection with the top open end of the upper 1. The fabric part 23' is made of a fluid-pervious fabric material.

Since the lining sleeve 2 or 2' is provided with a bottom open end, rather than a bottom wall, the bottom open end of the lining sleeve 2 or 2' can be secured to the upper 1 in a less complicated manner, and the consumption of the expensive waterproof vapor-permeable material can be reduced. As compared to the boot construction disclosed in the basic application of this application, the present invention provides a simpler construction whose drain outlet is not limited to the location where the upper and the lower of the boot are jointed.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A waterproof shoe comprising:

a sole;

an upper including a top open end and a bottom open end mounted on said sole;

a lining sleeve disposed inside said upper, said lining sleeve having a top open end connected to said top open end of said upper, and a bottom open end extending along an inner surface of said upper and ending at a distance from and above a surface of said sole extending within said upper, said bottom open end of said lining sleeve being stitched directly to said upper to form a seam above said surface of said sole, said lining sleeve being made of a material which is impervious to water but is pervious to perspiration vapors; and a waterproof member attached to the inner surface of said upper and a surface of said lining sleeve adjacent to and along said seam so that water invading the shoe can be diverted to drain out of the shoe through said seam.

2. The waterproof shoe as claimed in claim 1, wherein said waterproof member includes a waterproof tape extending downward from said seam to said bottom open end of said upper.

3. The waterproof shoe as claimed in claim 1, wherein said upper includes a toe part and a heel part, said seam forming a loop that extends from said toe part to said heel part and returns to said toe part from said heel part.

4. The waterproof shoe as claimed in claim 1, wherein said bottom open end of said lining sleeve is a folded bottom end which is turned upward and outward to be connected to the inner surface of said upper, said folded bottom end being stitched to said upper.

5. The waterproof shoe as claimed in claim 1, wherein said lining sleeve further has a top connection part stitched to said top open end of said lining sleeve, said top connection part being connected to said top open end of said upper and being made of a material which is different from that of said lining sleeve and which consists of a fluid-pervious material.

* * * * *